US011871855B2

(12) United States Patent
Li

(10) Patent No.: US 11,871,855 B2
(45) Date of Patent: Jan. 16, 2024

(54) DEVICE FOR TAKING CARE OF INFANTS, AND DRIVING MECHANISM

(71) Applicant: ZHONGSHAN CITY BOBIE BABY PRODUCT CO., LTD., Zhongshan (CN)

(72) Inventor: Xianfa Li, Zhongshan (CN)

(73) Assignee: ZHONGSHAN CITY BOBIE BABY PRODUCT CO., LTD., Zhongshan (CN)

( * ) Notice: Subject to any disclaimer, the term of this patent is extended or adjusted under 35 U.S.C. 154(b) by 0 days.

(21) Appl. No.: 17/905,479

(22) PCT Filed: Jun. 30, 2020

(86) PCT No.: PCT/CN2020/099069
§ 371 (c)(1),
(2) Date: Sep. 1, 2022

(87) PCT Pub. No.: WO2021/179486
PCT Pub. Date: Sep. 16, 2021

(65) Prior Publication Data

US 2023/0124305 A1 Apr. 20, 2023

(30) Foreign Application Priority Data

Mar. 9, 2020 (CN) ..... 202010156657.2

(51) Int. Cl.
*A47D 13/10* (2006.01)

(52) U.S. Cl.
CPC ..... *A47D 13/107* (2013.01)

(58) Field of Classification Search
CPC .... A47D 13/107; A47D 13/105; A47D 13/10; A47D 1/002; A47D 1/004; A47D 9/057
(Continued)

(56) References Cited

U.S. PATENT DOCUMENTS

2014/0221112 A1 8/2014 Gilbert et al.
2014/0315650 A1 10/2014 Pyrce et al.

FOREIGN PATENT DOCUMENTS

CN 201008471 Y 1/2008
CN 201019365 Y 2/2008
(Continued)

OTHER PUBLICATIONS

International Search Report and Written Opinion from International Application No. PCT/CN2020/099069 dated Dec. 10, 2020.

*Primary Examiner* — Milton Nelson, Jr.
(74) *Attorney, Agent, or Firm* — Dorsey & Whitney LLP

(57) ABSTRACT

The present invention relates to a device for taking care of infants, and a driving mechanism. The driving mechanism comprises a support, a first motion assembly and a second motion assembly, wherein a seat is arranged on the support, and since the first motion assembly and the second motion assembly are both arranged on the support, the first motion assembly drives the seat to swing in a first direction relative to the support, and the second motion assembly drives the seat to swing in a second direction relative to the support. Since the first direction intersects with the second direction, the motion of the seat is the superposition of the swinging in the first direction and the swinging in the second direction.

8 Claims, 7 Drawing Sheets

(58) Field of Classification Search
USPC ..... 297/259.1, 259.2, 259.3; 472/119
See application file for complete search history.

(56) References Cited

FOREIGN PATENT DOCUMENTS

| | | | | |
|---|---|---|---|---|
| CN | 202173059 | U | 3/2012 | |
| CN | 103300636 | A | 9/2013 | |
| CN | 104055355 | A | 9/2014 | |
| CN | 205814072 | U | 12/2016 | |
| CN | 108041897 | A | 5/2018 | |
| CN | 111166107 | A | 5/2020 | |
| WO | WO 8704327 | A1 * | 7/1987 | ..... A47D 9/04 |

* cited by examiner

DEVICE FOR TAKING CARE OF INFANTS, AND DRIVING MECHANISM

CROSS REFERENCE TO RELATED APPLICATION

This application is a U.S. national stage application under 35 U.S.C. § 371 from PCT International Patent Application No. PCT/CN2020/099069 filed on Jun. 30, 2020, which claims priority to Chinese Patent Application No. 2020101566572, filed on Mar. 9, 2020. The contents of the above-identified applications are hereby incorporated herein, in their entireties, by this reference.

TECHNICAL FIELD

The present disclosure relates to the technical field of infant products, in particular to an infant care device and a driving mechanism.

BACKGROUND

Conventional infant care devices generally realize swing movements via driving structures, thereby realizing a comforting effect on infants. However, the moving movements of the conventional infant care devices are too simple to effectively comfort the emotions of infants.

SUMMARY

Accordingly, it is necessary to provide an infant care device and a driving mechanism that can improve the comforting effect on infants in response to the aforementioned problems.

A driving mechanism includes:

a bracket configured to support a seat;

a first moving assembly disposed on the bracket, and configured to drive the seat to swing relative to the bracket in a first direction; and a second moving assembly disposed on the bracket, and configured to drive the seat to swing relative to the bracket in a second direction, wherein the first direction intersects the second direction.

When the aforementioned driving mechanism is in use, the seat is arranged on the bracket. Since the first moving assembly and the second moving assembly are both arranged on the bracket, the first moving assembly drives the seat to swing relative to the bracket in the first direction, and the second moving assembly drives the seat to swing relative to the bracket in the second direction. Since the first direction intersects the second direction, the movement of the seat can be a superposition of the swing in the first direction and the swing in the second direction. The first moving assembly and the second moving assembly are configured to effectively improve the moving state of the seat, so as to enrich the moving state of the seat, thereby effectively simulating a moving state of an infant in the mother's womb, or simulating a state of the infant in the arms of an adult, which improves the comforting effect on the infant.

In one of the embodiments, the first moving assembly includes a first power source, a first crank, a first connecting rod and a first support member. The first crank and the first support member are connected to opposite ends of the first connecting rod respectively, the first power source is configured to drive the first crank to rotate, and an end of the first support member away from the first connecting rod is rotatably arranged on the bracket.

In one of the embodiments, the first moving assembly further includes a first detection member configured to detect a rotation speed of the first crank.

In one of the embodiments, the first moving assembly further includes an elastic member disposed between the bracket and the first support member, and a direction of an elastic force of the elastic member is a swing direction of the first support member.

In one of the embodiments, the second moving assembly includes a second power source, a second crank, a second connecting rod and a second support member. The second crank and the second support member are connected to opposite ends of the second connecting rod respectively, the second power source is configured to drive the second crank to rotate, and an end of the second support member away from the second connecting rod is rotatably arranged on the bracket.

In one of the embodiments, the driving mechanism further includes a mounting member, wherein the mounting member is disposed on the second support member or a junction between the second connecting rod and the second support member, and the mounting member is configured to mount the seat.

In one of the embodiments, the second moving assembly further includes a second detection member configured to detect a rotation speed of the second crank.

In one of the embodiments, the second moving assembly is arranged on the first moving assembly, an end of the second support member away from the second connecting rod is rotatably arranged on the first support member, and the second support member is configured to mount the seat; or the first moving assembly is arranged on the second moving assembly, an end of the first support member away from the first connecting rod is rotatably arranged on the second support member, and the first support member is configured to mount the seat.

In one of the embodiments, the first direction is located on a vertical plane; and/or the second direction is located on a horizontal plane.

An infant care device includes:

a seat; and the aforementioned driving mechanism, wherein the seat is arranged on the bracket.

When the aforementioned infant care device is in use, the seat is arranged on the bracket. Since the first moving assembly and the second moving assembly are both arranged on the bracket, the first moving assembly drives the seat to swing relative to the bracket in the first direction, and the second moving assembly drives the seat to swing relative to the bracket in the second direction. Since the first direction intersects the second direction, the movement of the seat can be a superposition of the swing in the first direction and the swing in the second direction. The first moving assembly and the second moving assembly are configured to effectively improve the moving state of the seat, so as to enrich the moving state of the seat, thereby effectively simulating the moving state of the infant in the mother's womb, or simulating the state of the infant in the arms of the adult, which improves the comforting effect for the infant.

DESCRIPTION OF THE REFERENCE NUMERALS

10: infant care device; 100: seat; 20: driving mechanism; 200: bracket; 210: rotation shaft; 300: first moving assembly; 310: first power source; 320: first crank; 330: first connecting rod; 340: first support member; 342: rotation groove; 350: first detection member; 360: elastic member; 400: second moving assembly; 410: second crank; 420: second connecting rod; 430: second support member; 440: second detection member; 450: connecting member; 500: mounting member; 600: toy frame.

DETAILED DESCRIPTION OF THE EMBODIMENTS

In order to make the aforementioned objects, features and advantages of the present disclosure more clearly understood, specific embodiments of the present disclosure will be described in detail below with reference to the accompanying drawings. In the following description, numerous specific details are set forth in order to provide a thorough understanding of the present invention. However, the present disclosure can be implemented in many other ways different from those described herein, and those skilled in the art can make similar improvements without departing from the connotation of the present disclosure. Therefore, the present disclosure is not limited by the specific implementation disclosed below.

It should be understood that when an element is defined as "fixed to" another element, it is either directly on an element or indirectly on an element with a mediating element. When an element is considered to be "connected to" another element, it can be directly connected to another element or indirectly connected to another element with a mediating element. The terms "vertical", "horizontal", "left", "right" and similar expressions used herein are for the purpose of illustration only and do not represent the only embodiment.

All technical and scientific terms used herein have the same meaning as commonly understood by skilled person in the art to which the present disclosure belongs, unless otherwise defined. The terms used herein in the description of the present disclosure are for the purpose of describing specific embodiments only, and are not intended to limit the present disclosure. The technical features of the aforementioned embodiments may be combined arbitrarily. To simplify the description, not all the possible combinations of the technical features in the aforementioned embodiments are described. However, all of the combinations of these technical features should be considered as within the scope of the present disclosure, as long as such combinations do not contradict with each other.

Figure 1:
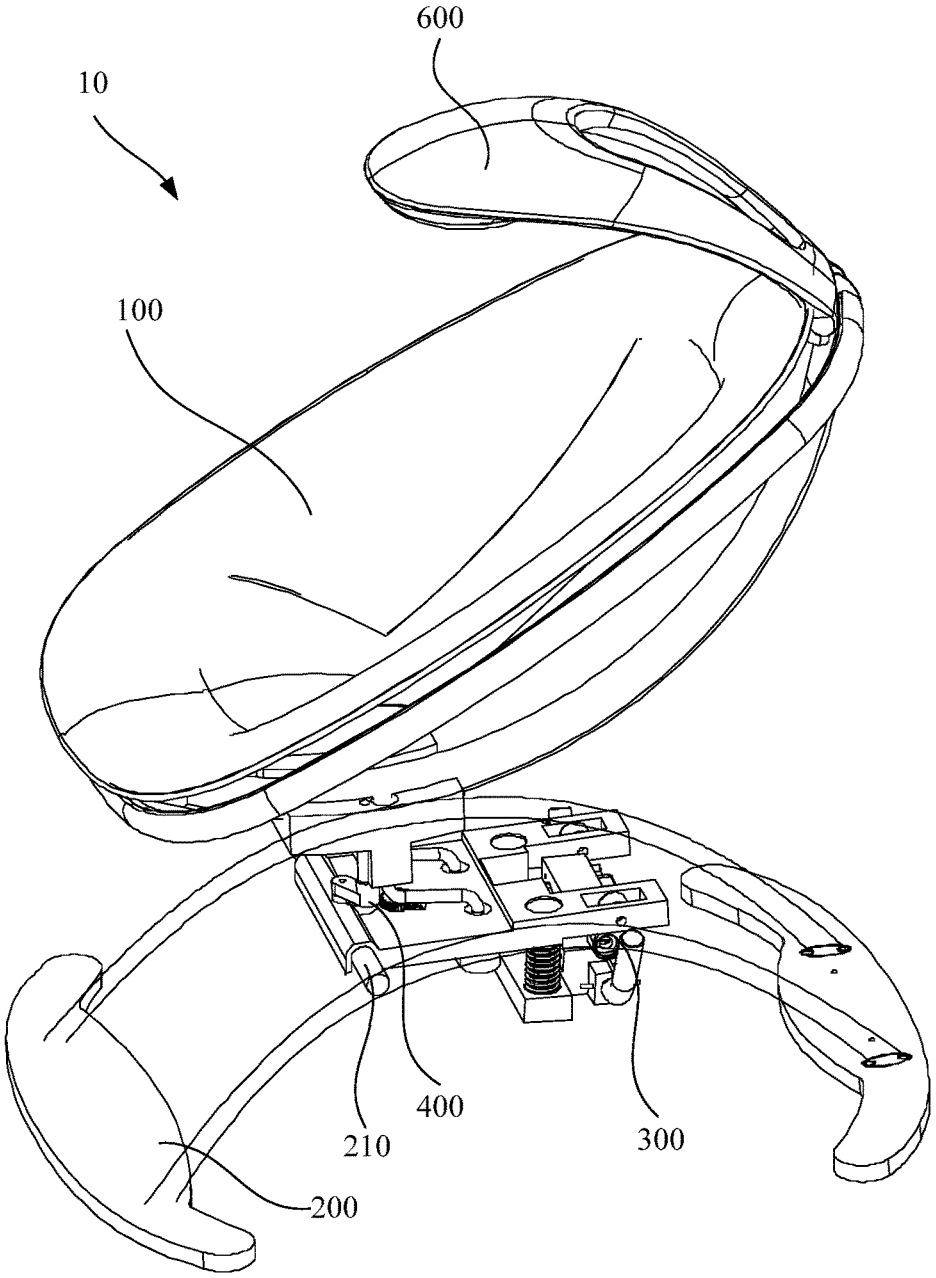
FIG. 1 is a schematic view of an infant care device according to an embodiment.
Figure 2:
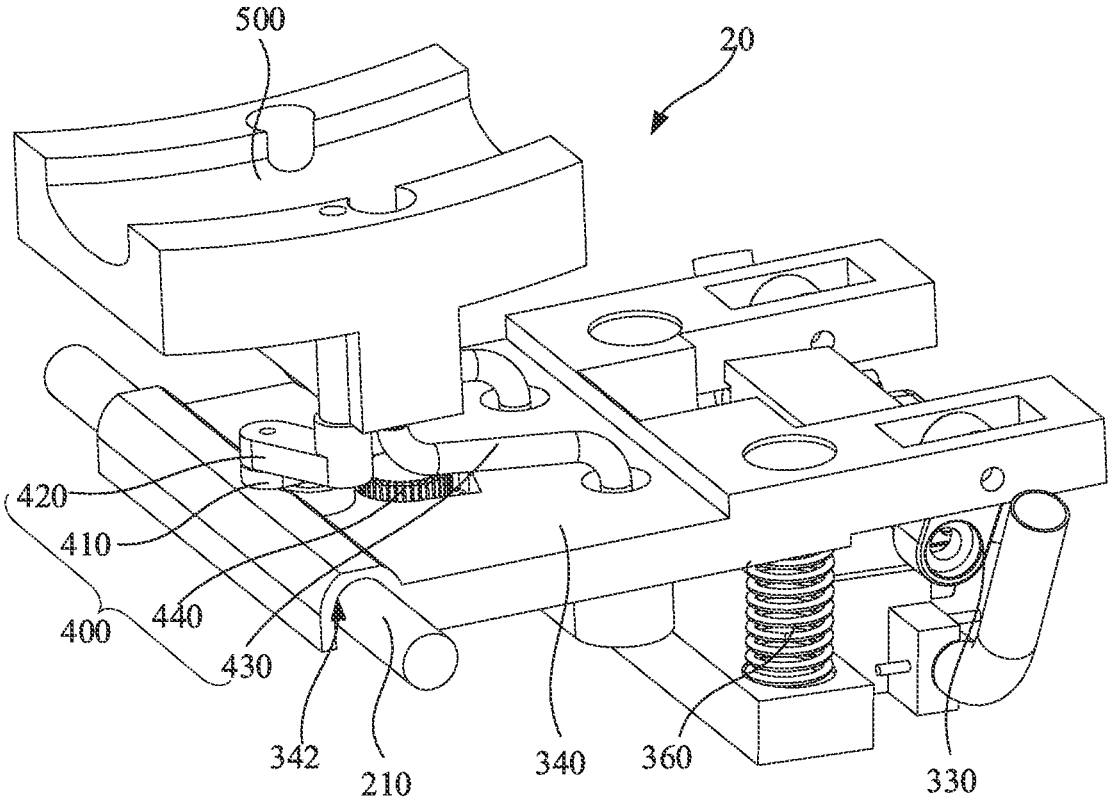
FIG. 2 is a schematic view of a driving mechanism shown in FIG. 1.

Referring to FIG. 1 and FIG. 2, an infant care device 10 configured to take care and comfort infants is provided according to an embodiment. Specifically, the infant care device 10 includes a seat 100 and a driving mechanism 20. The driving mechanism 20 includes a bracket 200, a first moving assembly 300, and a second moving assembly 400. The bracket 200 is configured to support the seat 100. The first moving assembly 300 is arranged on the bracket 200, and the first moving assembly 300 is configured to drive the seat 100 to swing relative to the bracket 200 in a first direction. The second moving assembly 400 is arranged on the bracket 200. The second moving assembly 400 is configured to drive the seat 100 to swing relative to the bracket 200 in a second direction, and the first direction intersects the second direction.

When the aforementioned infant care device 10 is in use, the seat 100 is arranged on the bracket 200. Since both the first moving assembly 300 and the second moving assembly 400 are arranged on the bracket 200, the first moving assembly 300 drives the seat 100 to swing relative to the bracket 200 in the first direction, and the second moving assembly 400 drives the seat 100 to swing relative to the bracket 200 in the second direction. Since the first direction intersects the second direction, the movement of the seat 100 can be a superposition of a swing in the first direction and a swing in the second direction. The first moving assembly 300 and the second moving assembly 400 are configured to effectively improve a moving state of the seat 100, thereby enriching the moving state of the seat 100, effectively simulating a moving state of an infant in the mother's womb, or simulating a state of the infants in the arms of an adult, thus the comforting effect for the infant is improved.

However, a conventional infant care device generally achieves the effect of comforting the infant by driving the seat to move. A moving movement of the seat is simple, and a setting angle of the seat does not change, so it cannot effectively simulate the moving state of the infant in the mother's womb, or the state of being in the arms of the adult, thus the comforting effect is poor. The aforementioned infant care device 10 utilizes the superposition of the swing in the first direction and the swing in the second direction to achieve not only a moving effect of the seat within a swing range, but also a rotation effect of the seat within the swing range, thereby simulating the moving state of the infant in the mother's womb or in the arms of the adult, thus the comforting effect is improved.

In one embodiment, the first direction is located on a vertical plane, such that the seat 100 can be swung on the vertical plane by using the first moving assembly 300.

In one embodiment, the second direction is located on a horizontal plane, such that the seat 100 can be swung on the horizontal plane by using the second moving assembly 400. The superposition of the swing on the vertical plane and the swing on the horizontal plane further facilitates the enrichment of the moving state of the seat 100 and improves the comforting effect.

In other embodiments, the first direction may also deviate from the vertical plane. The second direction may also deviate from the horizontal plane, as long as the first direction intersects the second direction, and the superposition of the swing in the first direction and the swing in the second direction can be achieved.

In this embodiment, the second moving assembly 400 is disposed on the first moving assembly 300, such that the swing of the second moving assembly 400 in the second direction is achieved on the basis of the swing in the first direction, and to facilitate the superposition of the swing in the first direction and the swing in the second direction, which is further beneficial to drive the seat 100 to simulate the moving state of the infant in the mother's womb or in the arms of the adult, thus the comforting effect is improved.

Figure 3:
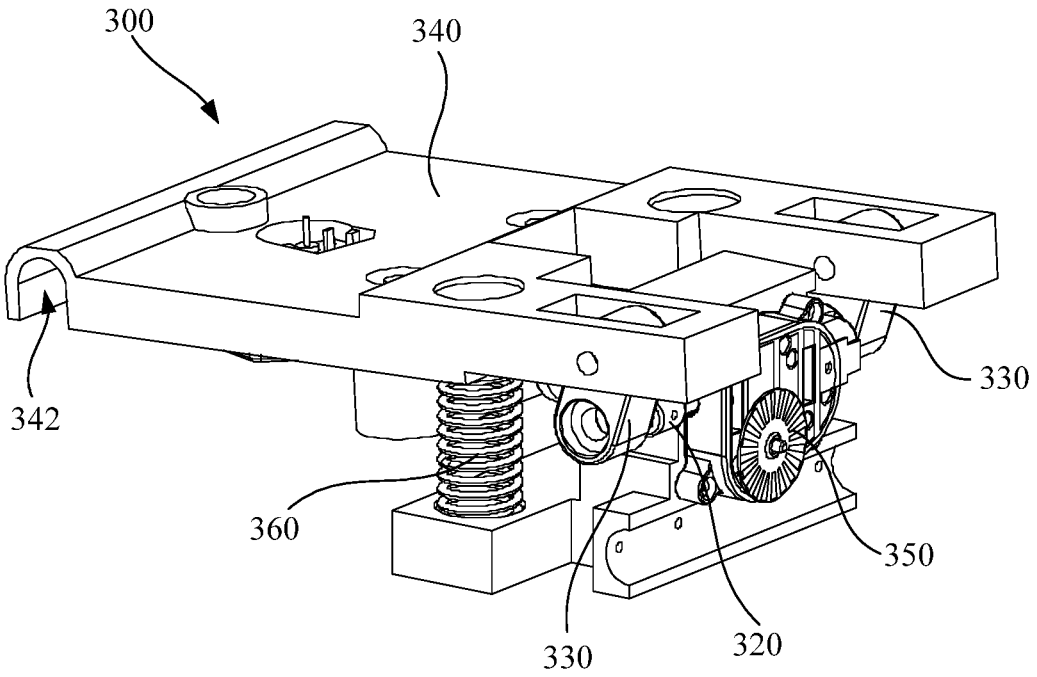
FIG. 3 is a schematic view of a first moving assembly shown in FIG. 2.
Figure 4:
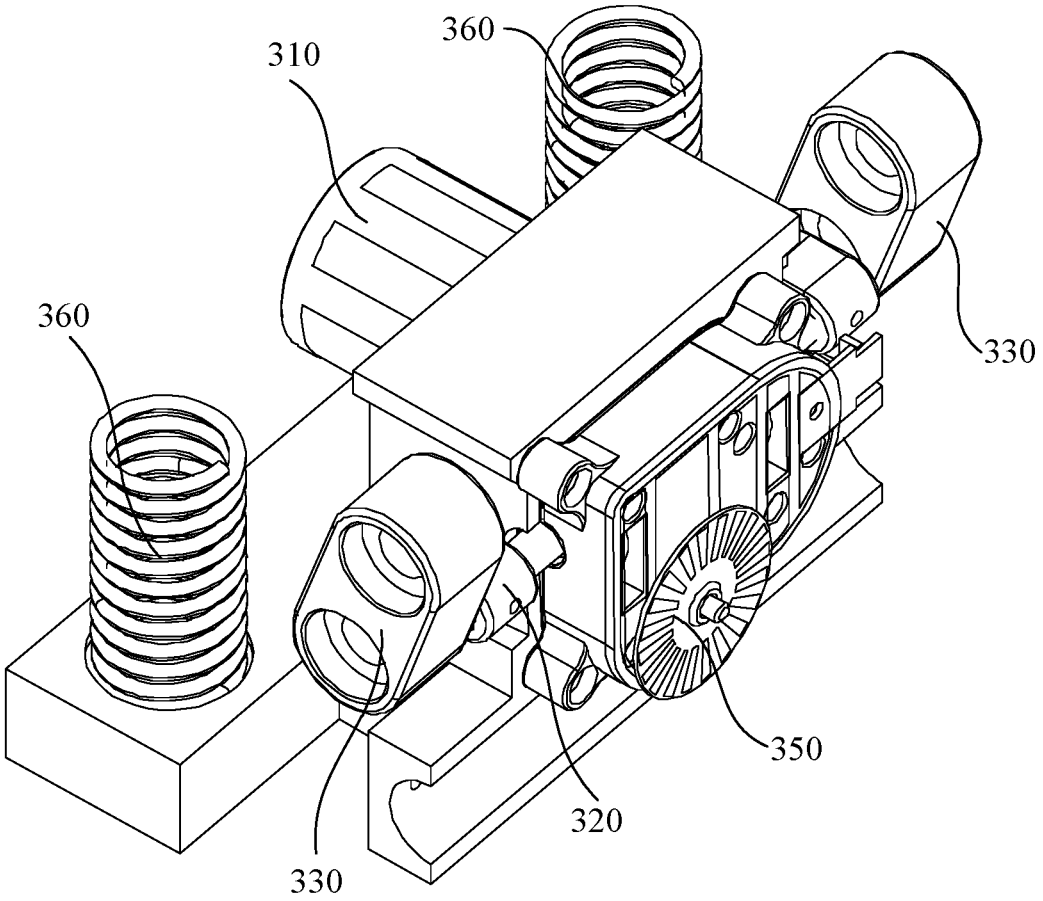
FIG. 4 is a schematic view of the first moving assembly shown in FIG. 3, where the first support member is omitted.

Referring to FIG. 3 and FIG. 4, in one embodiment, the first moving assembly 300 includes a first power source 310, a first crank 320, a first connecting rod 330, and a first support member 340. The first crank 320 and the first support member 340 are connected to opposite ends of the first connecting rod 330, respectively. The first power source 310 is configured to drive the first crank 320 to rotate. An end of the first support member 340 away from the first connecting rod 330 is rotatably mounted on the bracket 200. The seat 100 is disposed on the first support member 340. When in use, the first crank 320 is driven to rotate by the first power source 310, and the first crank 320 drives the first support member 340 to swing relative to the bracket 200 in the first direction via the first connecting rod 330, thereby realizing the swing of the seat 100 along the first direction.

In other embodiments, the first crank 320 may also be an eccentric wheel structure, as long as the swing of the first support member 340 can be achieved.

In this embodiment, the second moving assembly 400 is disposed on the first support member 340, and the seat 100 is disposed on the second moving assembly 400. It is convenient to realize the superposition of the swing in the first direction and the swing in the second direction, thereby enriching a moving trajectory of the seat 100.

Specifically, the first support member 340 has a plate-like structure, and the second moving assembly 400 is disposed on the first support member 340. By arranging the first support member 340 to be the plate-like structure, an area for supporting the second moving assembly 400 can be increased, thereby improving the support stability of the second moving assembly 400 and the driving stability of the seat 100. In other embodiments, the first support member 340 may also have a rod-shaped structure or a structure of other shapes, as long as it can conveniently support the second moving assembly 400 or the seat 100.

Optionally, an end of the first support member 340 away from the first connecting rod is provided with a rotation groove 342, a rotation shaft 210 (as shown in FIG. 1) is formed on the bracket 200, and a side of the rotation groove 342 facing the rotation shaft 210 has an opening, and the rotating shaft 210 can be inserted into the rotation groove 342 through the opening. An end of the first support member 340 away from the first connecting rod can be rotated relative to the bracket 200 via the rotation shaft 210, and meanwhile, the first support member 340 is mounted on the bracket 200 using the rotation groove 342, thus improving the convenience of mounting. In other embodiments, the rotation groove 342 may not be formed with an opening, and the rotation shaft 210 extends into the rotation groove 342, which can improve the rotation stability of the first support member 340 relative to the bracket 200.

In one embodiment, two groups of the first cranks 320 and the first connecting rods 330 are provided, and two groups of first connecting rods 330 are connected to the first support member 340 at intervals. Since the first support member 340 has the plate-like structure, the two groups of the first cranks 320 simultaneously drive the first support member 340 to swing via the first connecting rod 330, thereby improving the driving stability of the first support member 340. In other embodiments, one group, three groups, or other number of groups of the first cranks 320 and the first connecting rods 330 may also be provided, as long as the swing of the first support member 340 can be conveniently realized.

In this embodiment, the first power source 310 is a motor, and the first crank 320 is conveniently driven by the motor. Specifically, the first moving assembly 300 further includes a gear box, and the first crank 320 is connected to the first power source 310 via the gear box. A rotation speed transmitted from the first power source 310 to the first crank 320 is conveniently adjusted by the gear box, and meanwhile, the gear box facilitates the driving of two or other number of first cranks 320 via one first power source 310.

In one embodiment, the first moving assembly 300 further includes a first detection member 350 configured to detect a rotation speed of the first crank 320. The rotation speed of the first crank 320 can be effectively determined by the first detection member 350, and then a swing speed of the seat 100 driven by the first support member 340 in the first direction can be determined, thereby facilitating the adjustment of the swing speed of the seat 100 by adjusting the rotation speed of the first crank 320, thereby realizing the adjustment of different swinging speeds of the seat 100 in the first direction, and further enrich the movement of the seat 100.

Specifically, the first detection member 350 includes a first sensor and a first rotation member. The first sensor is disposed on the first power source 310 or on the bracket 200, and the first rotation member rotates along with the first crank 320. The first sensor is configured to detect the rotation of the first rotation member. In this embodiment, the first rotation member is a grating rotating portion, and the first sensor detects the rotation speed of the first crank 320 by detecting the grating rotating portion. In other embodiments, the first detection member 350 may also have other structures, as long as the detection of the speed of the first crank 320 can be realized.

In one embodiment, the first moving assembly 300 further includes an elastic member 360 disposed between the bracket 200 and the first support member 340, and a direction of an elastic force of the elastic member 360 is a swing direction of the first support member 340. By arranging the elastic member 360 between the bracket 200 and the first support member 340, a certain buffering force can be provided for the swing of the first support member 340, and a swing stability of the first support member 340 in the first direction can be further improved. Thus, a swing stability of the seat 100 in the first direction is improved. Meanwhile, since the first direction is the vertical direction, when the infant is placed on the seat 100, the elastic force of the elastic member 360 can effectively support the seat 100, thereby reducing the pressure cause by the weight of the seat 100 and the infant on the first moving assembly 300, and improving the driving stability and service life of the first moving assembly 300.

Specifically, the elastic member 360 is located at a position of the first support member 340 adjacent to the first connecting rod 330. It is convenient for the elastic member 360 to support the first support member 340 more effectively.

In this embodiment, there are at least two elastic members 360, and the at least two elastic members 360 are disposed between the bracket 200 and the first support member 340 at intervals. The employment of at least two elastic members 360 can further improve the support effect for the first support member 340, improve the support stability, and further reduce the pressure cause by the weight of the seat 100 and the infant on the first moving assembly 300. Specifically, there are two elastic members 360, and the two elastic members 360 are disposed between the first support member 340 and the bracket 200 at intervals. In other embodiments, three, four or other numbers of the elastic members 360 may also be provided, as long as they can be effectively support between the first support member 340 and the bracket 200 to provide a buffering effect for the swing of the first support frame.

In this embodiment, the elastic member 360 is a spring. In other embodiments, the elastic member 360 may also be the elastic member 360 made of other elastic materials.

Figure 5:
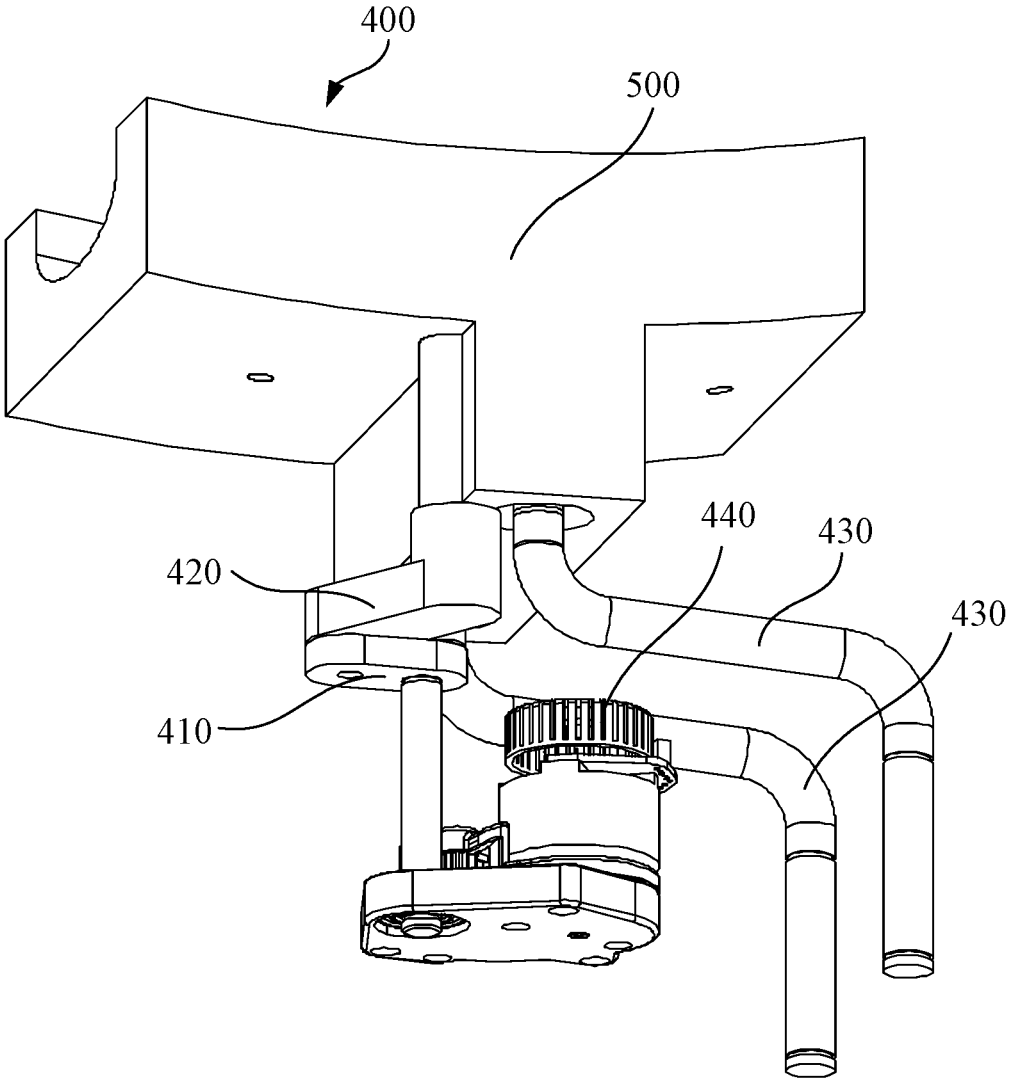
FIG. 5 is a structural diagram illustrating the second moving assembly shown in FIG. 2.

Referring to FIGS. 1, 2, and 5, in one embodiment, the second moving assembly 400 includes a second power source, a second crank 410, a second connecting rod 420 and a second support member 430. The second crank 410 and the second support member 430 are connected to opposite ends of the second connecting rod 420 respectively. The second power source is configured to drive the second crank 410 to rotate, and an end of the second support member 430 away from the second connecting rod 420 is rotatably arranged on the bracket 200. When in use, the second crank 410 is driven to rotate by the second power source, and the second crank 410 drives the second support member 430 to swing relative to the bracket 200 in the second direction via the second connecting rod 420, thereby realizing that the seat 100 swings in the second direction.

In other embodiments, the second crank 410 may also have an eccentric structure, as long as the second support member 430 can swing.

In this embodiment, one end of the second support member 430 away from the second connecting rod 420 is rotatably disposed on the first support member 340, and the second support member 430 is configured to mount the seat 100. Further, the second support member 430 can be driven by the first support member 340 to swing in the first direction, and the second support member 430 drives the seat 100 to swing relative to the first support member 340 in the second direction, thereby effectively enabling the seat 100 to swing in the first direction while swinging in the second direction, so as to realize the superposition of the swings in the two directions.

In one embodiment, there are two second support members 430, and the two second support members 430 arranged in parallel can be rotatably connected to an end of the second connecting rod 420 away from the second crank 410. Specifically, the two second support members 430 arranged in parallel can be rotatably connected to the seat 100, and an end of the second connecting rod 420 away from the second crank 410 is arranged on the seat 100. By arranging the two second support members 430, the stability of driving the seat 100 can be effectively improved, thereby improving a swing stability of the seat 100 in the second direction. In other embodiments, one, three or other numbers of the second support members 430 may also be provided, as long as the seat 100 can be supported conveniently and the seat 100 can be driven to swing in the second direction.

In one embodiment, the infant care device 10 further includes a mounting member 500. The mounting member 500 is disposed on the second support member 430 or at a junction between the second connecting rod 420 and the second support member 430, and the mounting member 500 is configured to mount the seat 100. By arranging the mounting member 500 on the second support member 430 or at the junction between the second connecting rod 420 and the second support member 430, it is convenient to mount the seat 100 on the second motion assembly 400, and the mounting stability of the seat 100 is improved.

Specifically, each of the second support members 430 is rotatably connected to the mounting member 500, and one end of the second connecting rod 420 away from the second crank 410 is rotatably connected to the mounting member 500. The mounting member 500 can not only facilitate the mounting of the seat 100, but also facilitate the connection of the second crank 410 and the second support member 430.

In this embodiment, the second power source is a motor, and the second crank 410 is conveniently driven by the motor. Specifically, the second moving assembly 400 further includes a gear box, and the second crank 410 is connected to the second power source via the gear box. A rotation speed of the second power source transmitted to the second crank 410 is conveniently adjusted by using the gear box.

In one embodiment, the second moving assembly 400 further includes a second detection member 440, and the second detection member 440 is configured to detect a rotation speed of the second crank 410. The rotation speed of the second crank 410 can be effectively determined by the second detection member 440, and then a swing speed of the seat 100 in the second direction driven by the second support member 430 can be determined, thereby facilitating the adjustment of the swing speed of the seat 100 in the second direction by adjusting the rotation speed of the second crank 410, thereby realizing the adjustment of different swing speeds of the seat 100 in the second direction, and further enriches the movement of the seat 100.

Specifically, the second detection member 440 includes a second sensor and a second rotation member. The second sensor is disposed on the second power source or on the first support member 340. The second rotation member rotates along with the second crank 410. The two sensors are configured to detect the rotation of the second rotation member. In this embodiment, the second rotation member is a grating rotating portion, and the second sensor detects the rotation speed of the second crank 410 by detecting the grating rotating portion. In other embodiments, the second detection member 440 may also have other structures, as long as it can detect the speed of the second crank 410.

In one embodiment, the infant care device 10 further includes a controller, and both the first power source 310 and the second power source are electrically connected to the controller. The controller is configured to control the rotation speeds output by the first power source 310 and the second power source. The rotation speeds of the first power source 310 and the second power source can be conveniently adjusted by the controller, and then the swing speed of the seat 100 in the first direction and the second direction can be conveniently adjusted. After the different swing speeds in the first direction and the different swing speeds in the second direction are superimposed, a variety of different moving trajectories can be realized, which further enriches the movement of the seat 100 and improves the comforting effect of the seat 100 on infants.

Specifically, the first detection member 350 and the second detection member 440 are both electrically connected to the controller, which facilitates the controller to detect the rotation speed of the first crank 320 and the rotation speed of the second crank 410, and further facilitates the controller to control the first power source 310 and the second power source to adjust the rotation speeds.

In one embodiment, the infant care device 10 further includes a toy frame 600 disposed on the seat 100. When the infant is placed on the seat 100, the toy frame 600 can effectively attract the attention of the infant and prevent the infant from crying.

In one embodiment, the infant care device 10 further includes an audio device, which is arranged on the seat 100 to further expand the functions of the infant care device 10 and improve the comforting effect. Optionally, the seat 100 may also be provided with a lamp, which can not only improve the effect of rendering the atmosphere and comfort, but also can achieve the effect of lighting.

Figure 6:
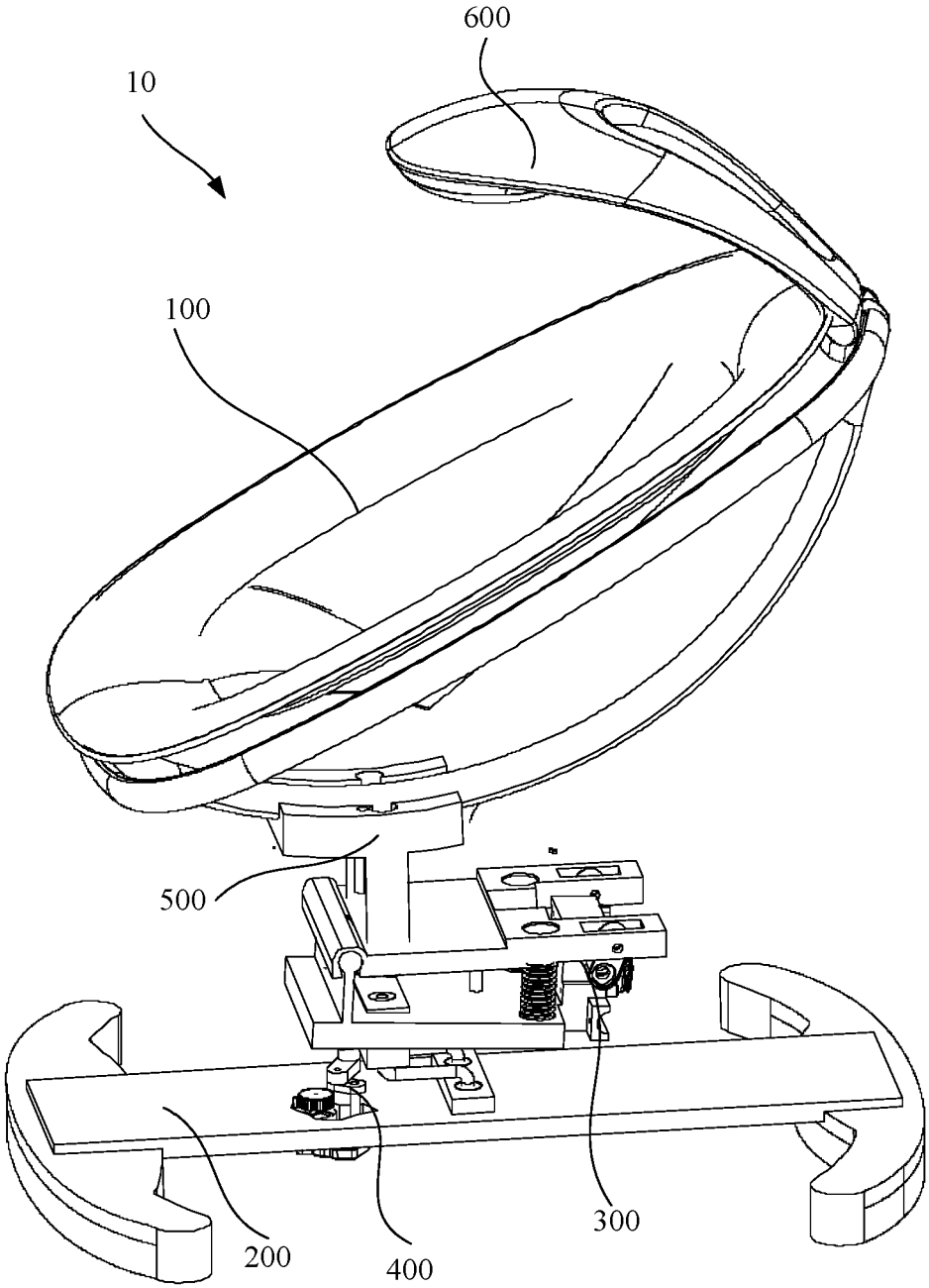
FIG. 6 is a schematic diagram illustrating an infant care device according to another embodiment.
Figure 7:
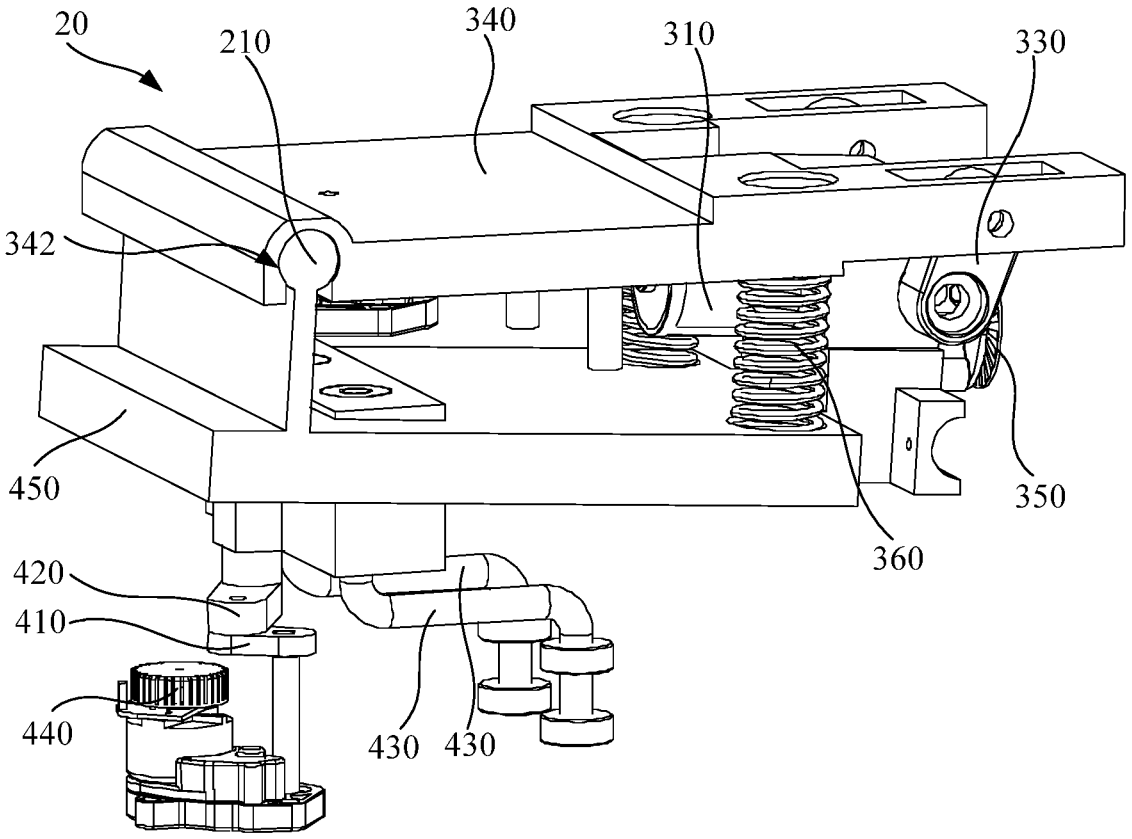
FIG. 7 is a schematic diagram illustrating a driving mechanism shown in FIG. 6.

Referring to FIG. 6 and FIG. 7, an infant care device 10 according to another embodiment is provided, which is different from the aforementioned infant care device 10 in that:

In this embodiment, the first moving assembly 300 is disposed on the second moving assembly 400. The second moving assembly 400 is capable of driving the first moving assembly 300 to swing in the second direction, and the first moving assembly 300 drives the seat 100 to swing in the first direction, thereby realizing the superposition of the swing of the seat 100 in the first direction and the second direction.

Specially, an end of the first support member 340 away from the first connecting rod 330 is rotatably arranged on the second support member 430, and the first support member 340 is configured to mount the seat 100. The use of the second support member 430 can not only effectively support the first moving assembly 300, but also facilitate the rotation of the first support member 340 relative to the second support member 430, so as to realize the swing of the first support member 340 relative to the second support member 430 in the second direction.

In this embodiment, the infant care device 10 further includes a mounting member 500 mounted on the first support member 340, and the seat 100 is disposed on the mounting member 500. The use of the mounting member 500 can improve the mounting stability of the seat 100 on the first support member 340. In other embodiments, the seat 100 may also be directly mounted on the first support member 340.

In this embodiment, the second moving assembly 400 further includes a connecting member 450 disposed on the second support member 430 or at the junction between the second connecting rod 420 and the second support member 430. The first moving assembly 300 is disposed on the connecting member 450, and an end of the first support member 340 away from the first connecting rod 330 is rotatably disposed on the connecting member 450. By arranging the connecting member 450, a mounting platform can be provided for the mounting of the first moving assembly 300, which facilitates arranging the first moving assembly 300 on the second moving assembly 400.

In an embodiment, each of the second support members 430 is rotatably connected to the connecting member 450, and an end of the second connecting rod 420 away from the second crank 410 is rotatably connected to the connecting member 450. The connecting member 450 can not only facilitate the mounting of the first moving assembly 300, but also facilitate the connection of the second crank 410 and the second support member 430.

Optionally, the connecting member 450 is provided with a rotation shaft 210, and an end of the first support member 340 away from the first connecting rod 330 is rotatably disposed on the rotation shaft 210. The use of the rotation shaft 210 not only facilitates the realization of the first support member 340 to swing relative to the connecting member 450 in the first direction, but also facilitates the mounting of the first support member 340 on the connecting member 450.

Specifically, the connecting member 450 has a plate-like structure, and the first moving assembly 300 is disposed on the connecting member 450 of the plate-like structure. By arranging the connecting member 450 having the plate-like structure, the support area for the first moving assembly 300 can be increased, thereby improving the support stability of the first moving assembly 300 and the driving stability of the seat 100. In other embodiments, the connecting member 450 can also have other structures, as long as the support of the first moving assembly 300 can be realized.

Further, the rotation shaft 210 is disposed on the connecting member 450 of the plate-like structure. In this embodiment, the rotation shaft 210 is integrally formed on the connecting member 450, which can improve a swing stability of the first support member 340 relative to the connecting member 450 via the rotation shaft 210. In other embodiments, the rotation shaft 210 may also be connected to the connecting member 450 by welding, gluing or other detachable connection methods.

Optionally, an end of the first support member 340 away from the first connecting rod is provided with a rotation groove 342. A side of the rotation groove 342 facing the rotation shaft 210 has an opening, and the rotation shaft 210 can be inserted into the rotation groove 342 through the opening, so as to realize that an end of the first support member 340 away from the first connecting rod is capable of rotating relative to the connecting member 450 via the rotation shaft 210. Meanwhile, the first support member 340 can be conveniently mounted on the connecting member 450 by using the rotation groove 342, thereby improving the convenience of mounting. In other embodiments, the rotation groove 342 may not have an opening, and the rotation shaft 210 extends into the rotation groove 342 to improve the rotation stability of the first support member 340 relative to the connection member 450.

In this embodiment, the elastic member 360 of the first moving assembly 300 is disposed between the connecting member 450 and the first support member 340. The direction of the elastic force of the elastic member 360 is the swing direction of the first support member 340. By arranging the elastic member 360 between the connecting member 450 and the first support member 340, a certain buffering force can be provided for the swing of the first support member 340, and the swing stability of the first support member 340 in the first direction can be further improved, thereby improving the swing stability of the seat 100 in the first direction. Meanwhile, since the first direction is the vertical direction, when the infant is placed on the seat 100, the elastic force of the elastic member 360 can effectively support the seat 100, thereby reducing the pressure caused by the weight of the seat 100 and the infant on the first moving assembly 300.

In other embodiments, the first moving assembly 300 and the second moving assembly 400 may also be disposed on the bracket 200, respectively. The first moving assembly 300 is configured to restrict the seat 100 from swinging in the first direction, and the second moving assembly 400 is configured to restrict the seat 100 from swinging in the second direction, as long as the superposition of the swings of the seat 100 in the first direction and the second direction can be achieved, so as to enrich the movement of the seat 100.

The aforementioned embodiments only represent several embodiments of the present disclosure, and the descriptions thereof are specific and detailed, but should not be construed as limiting the scope of the invention patent. It should be noted that a plurality of variations and modifications may be made by those skilled in the art without departing from the scope of the present disclosure, which are all within the scope of protection of the present disclosure. Therefore, the protection scope of this invention shall be defined by the appended claims.

What is claimed is:

1. A driving mechanism, comprising:

a bracket configured to support a seat;

a first moving assembly disposed on the bracket, and configured to drive the seat to swing relative to the bracket in a first direction; and a second moving assembly disposed on the bracket and connected to the first moving assembly, and configured to drive the seat to swing relative to the bracket in a second direction, wherein the first direction intersects the second direction, wherein:

the first moving assembly comprises a first power source, a first crank, a first connecting rod, and a first support member, the first crank and the first support member are connected to opposite ends of the first connecting rod, respectively, the first power source is configured to drive the first crank to rotate, and an end of the first support member away from the first connecting rod is rotatably arranged on the bracket;

the second moving assembly comprises a second power source, a second crank, a second connecting rod, and a second support member, the second crank and the second support member are connected to opposite ends of the second connecting rod, respectively, the second power source is configured to drive the second crank to rotate, and an end of the second support member away from the second connecting rod is rotatably arranged on the bracket; and the second moving assembly further comprises a second detection member configured to detect a rotation speed of the second crank.

2. The driving mechanism according to claim 1, further comprising a mounting member provided on the second support member or on a junction between the second connecting rod and the second support member, wherein the mounting member is configured to mount the seat.

3. The driving mechanism according to claim 1, wherein the second moving assembly is disposed on the first moving assembly, an end of the second support member away from the second connecting rod is rotatably arranged on the first support member, and the second support member is configured to mount the seat.

4. The driving mechanism according to claim 1, wherein the first direction is located on a vertical plane; and the second direction is located on a horizontal plane.

5. The driving mechanism according to claim 1, wherein the first moving assembly is arranged on the second moving assembly, an end of the first support member away from the first connecting rod is rotatably arranged on the second support member, and the first support member is configured to mount the seat.

6. An infant care device, comprising:

a seat; and the driving mechanism according to claim 1, wherein the seat is arranged on the bracket.

7. A driving mechanism, comprising:

a bracket configured to support a seat;

a first moving assembly disposed on the bracket, and configured to drive the seat to swing relative to the bracket in a first direction; and a second moving assembly disposed on the bracket, and configured to drive the seat to swing relative to the bracket in a second direction, wherein the first direction intersects the second direction;

wherein the first moving assembly comprises a first power source, a first crank, a first connecting rod, and a first support member, the first crank and the first support member are connected to opposite ends of the first connecting rod, respectively, the first power source is configured to drive the first crank to rotate, and an end of the first support member away from the first connecting rod is rotatably arranged on the bracket; and wherein the first moving assembly further comprises a first detection member configured to detect a rotation speed of the first crank.

8. A driving mechanism, comprising:

a bracket configured to support a seat;

a first moving assembly disposed on the bracket, and configured to drive the seat to swing relative to the bracket in a first direction; and a second moving assembly disposed on the bracket, and configured to drive the seat to swing relative to the bracket in a second direction, wherein the first direction intersects the second direction;

wherein the first moving assembly comprises a first power source, a first crank, a first connecting rod, and a first support member, the first crank and the first support member are connected to opposite ends of the first connecting rod, respectively, the first power source is configured to drive the first crank to rotate, and an end of the first support member away from the first connecting rod is rotatably arranged on the bracket; and wherein the first moving assembly further comprises an elastic member provided between the bracket and the first support member, and a direction of an elastic force of the elastic member is a swing direction of the first support member.

* * * * *